US005788583A

United States Patent [19]

Agulnek et al.

[11] Patent Number: 5,788,583

[45] Date of Patent: Aug. 4, 1998

[54] SYSTEM FOR PREDICTING THE DISTANCE WHICH WILL BE IMPARTED TO A GOLF BALL BY A PUTTING SWING, AND METHOD FOR USING SAME

[76] Inventors: Jeremy Agulnek, 1815 JFK Blvd., Apt. 924, Philadelphia, Pa. 19104; Eric Tavel, 15 Ennis Dr., Hazlet, N.J. 07730

[21] Appl. No.: 752,721

[22] Filed: Nov. 19, 1996

[51] Int. Cl.[6] ..... A63B 69/36

[52] U.S. Cl. ..... 473/225; 473/407

[58] Field of Search ..... 473/253, 252, 473/251, 407, 409, 278, 225, 219, 151

[56] References Cited

U.S. PATENT DOCUMENTS

| | | | |
|---|---|---|---|
| 4,180,270 | 12/1979 | Long | 473/225 |
| 4,254,956 | 3/1981 | Rusnak | 473/225 |
| 4,306,723 | 12/1981 | Rusnak | 473/225 |
| 4,844,469 | 7/1989 | Yasuda et al. | 473/225 |
| 5,108,105 | 4/1992 | Shimizu | 473/225 |
| 5,472,205 | 12/1995 | Boutin | 473/409 X |

*Primary Examiner*—Jessica Harrison
*Assistant Examiner*—Michael O'Neill
*Attorney, Agent, or Firm*—Reed Smith Shaw & McClay LLP

[57] ABSTRACT

An apparatus for determining a predicted distance that a golf ball will travel when struck by a putter club head during a putting swing. A first optical sensor is located in a first position for sensing when the putter club head travels over the first position during the putting swing. A second optical sensor is located in a second position for sensing when the putter club head travels over the second position during the putting swing. The second position is a predetermined distance away from the first position. A timer, coupled to the first and second optical sensors, is provided for generating a time difference value representing a difference between a first time when the putter club head travels over the first position during the putting swing and a second time when the putter club head travels over the second position during the putting swing. A microprocessor is provided for determining the predicted distance in accordance with the time difference value and the predetermined distance. Means for communicating the predicted distance determined by the microprocessor to a user are also provided.

A method for accurately putting a golf ball positioned on a putting green. An actual putting distance between the golf ball and a hole on the putting green is estimated by a golfer. While the golf ball remains positioned on the putting green, the golfer moves a putting club head over a pair of sensors with a practice putting swing to determine a predicted putting distance. Next, while the ball remains on the putting green, the golfer compares the actual putting distance with the predicted putting distance determined using the sensors. If the actual putting distance and the predicted putting distance are not within a predetermined threshold, then the golfer continues to swing the putter club head over the sensors until the actual putting distance and the predicted putting distance determined using the sensors are within the predetermined threshold. When the actual putting distance and the predicted putting distance determined using the sensors are within the predetermined threshold, the golfer then putts the golf ball toward the hole.

13 Claims, 6 Drawing Sheets

SYSTEM FOR PREDICTING THE DISTANCE WHICH WILL BE IMPARTED TO A GOLF BALL BY A PUTTING SWING, AND METHOD FOR USING SAME

FIELD OF THE INVENTION

In general, this invention relates to putters used in the game of golf and, more specifically, to devices which may be used to train and assist a golfer in the development and maintenance of a desirable putting stroke.

BACKGROUND

When a golfer swings with a wood or an iron club, the golfer typically uses a single stroke to strike the golf ball, regardless of the club being used. Thus, regardless of whether the golfer is using five-iron club or a nine-iron club, the golfer will typically strike the golf ball with the same club velocity. In such instances, the distance that the golf ball travels varies depending on the angle of the iron club. Since a golfer typically uses the same stroke with every iron and wood type club, it is possible for a golfer to develop over time a feel for a particular stroke which the golfer will use every time that the golfer swings a wood or iron club.

In contrast to wood and iron club swings, a golfer in a putting situation does not typically strike the ball with the same club velocity regardless of the length of the putt. Instead, the golfer must adjust the velocity of the putting stroke while on the green in order to compensate for the length of a particular putt. Since the golfer must vary the velocity of the putting stroke for every putt, it is considerably more difficult in the case of putting for a golfer to develop a feel for a proper stroke. It would therefore be desirable to have a device which a golfer could use during a game situation in order to get a feel for a proper putting stroke in advance of attempting to make a putt. More particularly, it would be desirable for a golfer to have a device which the golfer could use, immediately before attempting to make a putt, in order to establish that the golfer is swinging the putter with a velocity that matches the distance of the putt the golfer is attempting to make.

It is therefore an object of the present invention to provide a device which a golfer can use during a game situation and within the limits of golf etiquette, in order to get a feel for a proper putting stroke in advance of attempting to make a putt.

It is a further object of the present invention to provide a device which the golfer can use, immediately before attempting to make a putt, in order to establish that the golfer is swinging the putter with a velocity that matches the distance of the putt the golfer is attempting to make.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

The present invention is directed to an apparatus for determining a predicted distance that a golf ball will travel when struck by a putter club head during a putting swing. A first optical sensor is located in a first position for sensing when the putter club head travels over the first position during the putting swing. A second optical sensor is located in a second position for sensing when the putter club head travels over the second position during the putting swing. The second position is a predetermined distance away from the first position. A timer, coupled to the first and second optical sensors, is provided for generating a time difference value representing a difference between a first time when the putter club head travels over the first position during the putting swing and a second time when the putter club head travels over the second position during the putting swing. A microprocessor is provided for determining the predicted distance in accordance with the time difference value and the predetermined distance. Means for communicating the predicted distance determined by the microprocessor to a user are also provided.

In accordance with a further embodiment, the present invention is directed to a method for accurately putting a golf ball positioned on a putting green. An actual putting distance between the golf ball and a hole on the putting green is estimated by a golfer. Next, while the golf ball remains on the putting green, the golfer places a device with a pair of sensors on or near the green. With the device so positioned, the golfer moves a putting club head over the pair of sensors with a practice putting swing to determine a predicted putting distance. Next, while the ball remains on the putting green, the golfer compares the actual putting distance with the predicted putting distance determined using the sensors. If the actual putting distance and the predicted putting distance are not within a predetermined threshold, then the golfer continues to swing the putter club head over the sensors until the actual putting distance and the predicted putting distance determined using the sensors are within the predetermined threshold. When the actual putting distance and the predicted putting distance determined using the sensors are within the predetermined threshold, the golfer then putts the golf ball toward the hole.

BRIEF DESCRIPTION OF THE DRAWINGS

In order that the manner in which the above-recited and other advantages and objects of the invention are obtained and can be appreciated, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention and the presently understood best mode thereof will be described and explained with additional specificity and detail through the use of the accompanying drawings.

DETAILED DESCRIPTION OF THE INVENTION

Figure 1:
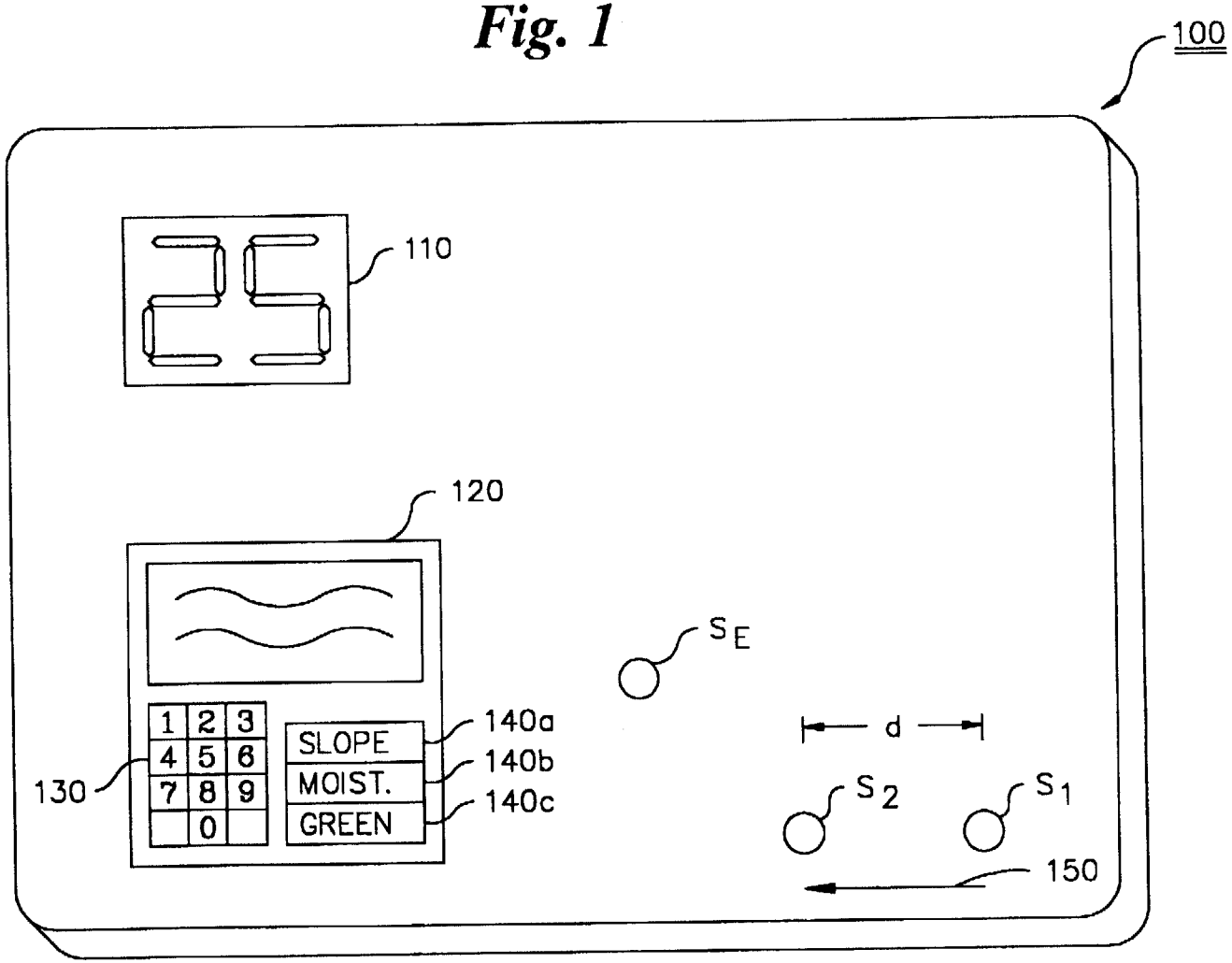
FIG. 1 is an isometric view of a device for predicting the distance which will be imparted to a golf ball by a putting swing, in accordance with a preferred embodiment of the present invention.
Figure 2:
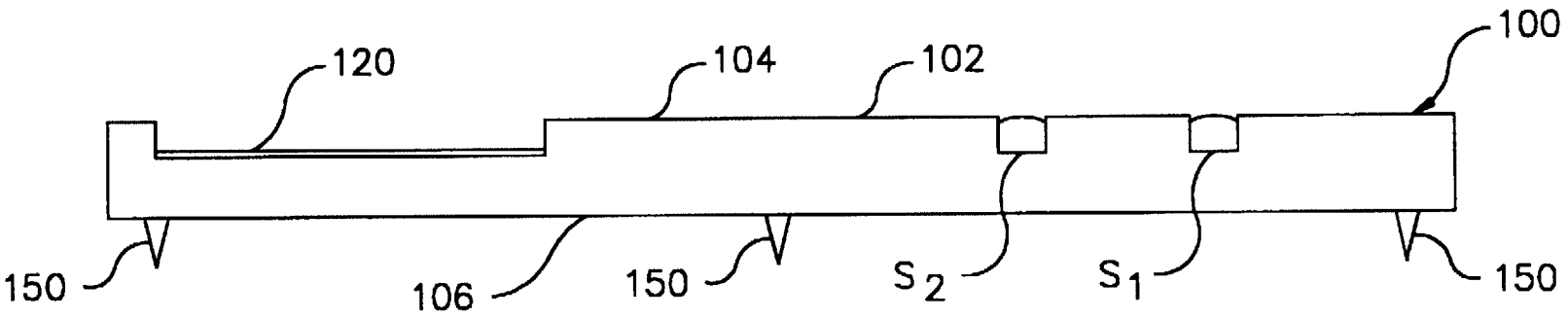
FIG. 2 is a side view of the device shown in FIG. 1.

Referring now to FIGS. 1 and 2, there are shown isometric and side views, respectively, of a device 100 for predicting the distance which will be imparted to a golf ball by a putting swing, in accordance with a preferred embodiment of the present invention. Device 100 includes a pair of optical sensors $S_1$ and $S_2$ which are separated by a predetermined distance "d". Each sensor $S_1$, $S_2$ may be formed, for example, from a phototransistor such as the TO-18 phototransistor marketed by National Semiconductor. Sensors $S_1$ and $S_2$ are disposed within a device housing 102. The housing 102 includes a flat upper surface 104 and a flat bottom surface 106. The housing 102 may be made of plastic, or any other suitably durable material. In the preferred embodiment shown in FIG. 2, sensors $S_1$ and $S_2$ are preferably disposed in a recessed position such that the top ends of the sensors $S_1$ and $S_2$ are positioned below the upper surface 104 of the housing. In alternate embodiments (not shown), the top ends of the sensors $S_1$ and $S_2$ may be positioned slightly above the upper surface 104 of the housing. In one embodiment, housing 102 has a length of about 6 inches, a width of about 4 inches, a depth of about 1 inch, and the sensors $S_1$ and $S_2$ are disposed within the housing such that the sensors are separated by a distance "d" of approximately 1 inch. A plurality of spikes 150 are preferably secured to the bottom surface 106 of the housing. The spikes 150 function to secure device 100 to the surface of a putting green during use of the device. Housing 102 is preferably as small and thin as practicable.

Referring still to FIGS. 1 and 2, the device 100 preferably includes a user-interface 120 which is also disposed in a recessed position within the housing 102. During operation of the device, a golfer uses interface 120 to input information about the condition of the putting green on which the golfer is about to attempt a putt. More particularly, the golfer uses button 140*a* and keypad 130 to input a number representing the slope (e.g., uphill, downhill, level) of the putt that the golfer is about to attempt; the golfer uses button 140*b* and keypad 130 to input a number representing the moisture level (e.g., wet, normal, dry) of the putting green on which the golfer is about to attempt a putt; and the golfer uses button 140*c* and keypad 130 to input a number representing the particular hole and course (e.g., Hole 13 of Pebble Beach, etc.) on which the golfer is about to attempt a putt. Device 100 also includes a visual display 110, for displaying predicted distance information to the golfer before the golfer attempts to make a putt. It will be understood by those skilled in the art that other communicating means, such as a computer generated audio output, could be used in place of display 110 for communicating this predicted distance information to the golfer. In the preferred embodiment, device 100 includes a third optical sensor $S_e$ which also may be formed, for example, from a phototransistor such as the TO-18 phototransistor marketed by National Semiconductor. As explained more fully below, the third optical sensor $S_e$ functions to detect the level of background or ambient light which reaches the first and second optical sensors $S_1$ and $S_2$.

Figure 3:
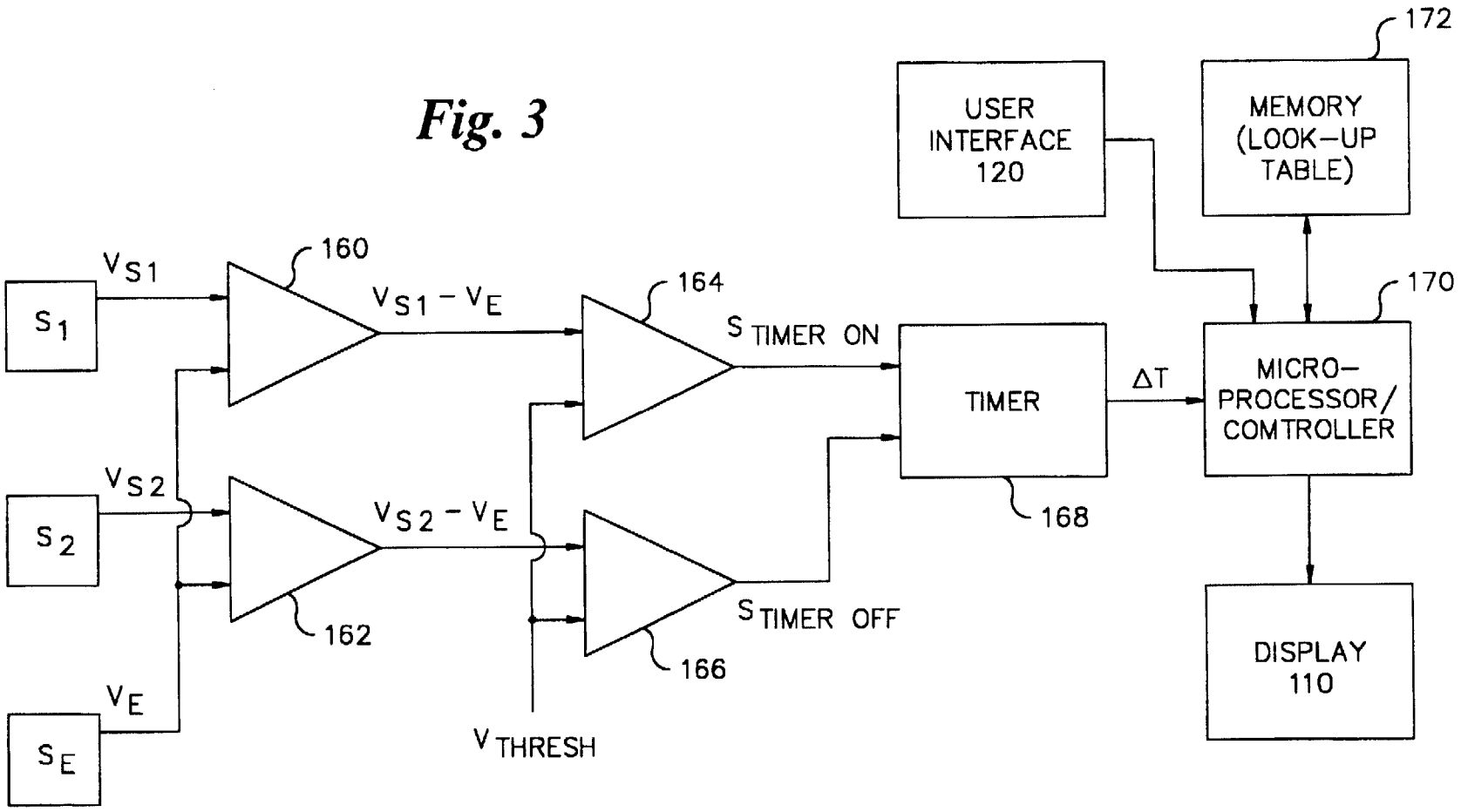
FIG. 3 is a functional block diagram illustrating the operation of a device for predicting the distance which will be imparted to a golf ball by a putting swing, in accordance with a preferred embodiment of the present invention.

Referring now to FIG. 3, there is shown a functional block diagram illustrating how device 100 functions to predict the distance which will be imparted to a golf ball by a putting swing, in accordance with a preferred embodiment of the present invention. As shown in FIG. 3, sensors $S_1$, $S_2$ and $S_e$ respectively output voltage signals $V_{s1}$, $V_{s2}$ and $V_e$. Each voltage signal $V_{s1}$, $V_{s2}$, $V_e$ represents the intensity of light striking one of optical sensors $S_1$, $S_2$, $S_e$, respectively. During use of device 100, a golfer first places the bottom surface 106 of device 100 onto a putting green. The golfer then stands over device 100 with a putter club and performs a practice putting swing over the upper surface 104 of device 100 in the direction of the arrow 150 (shown in FIG. 1). During this practice putting swing, the golfer swings the putter club as if the golfer were putting a golf ball lying on surface 104 and positioned equidistant between sensors $S_1$ and $S_2$, even though no such golf ball is actually positioned on surface 104 during the practice swing. As the head of the putter club moves over optical sensor $S_1$ during the practice putting swing, the light intensity sensed by optical sensor $S_1$ momentarily decreases, because the club head blocks any ambient light from reaching the sensor $S_1$ during the part of the swing when the club head is positioned directly above the sensor $S_1$. Similarly, as the head of the putter club moves over optical sensor $S_2$ during the practice putting swing, the light intensity sensed by optical sensor $S_2$ momentarily decreases, because the club head blocks ambient light from reaching the sensor $S_2$ during the part of the swing when the club head is positioned directly above the sensor $S_2$. During the practice swing described above, the head of the putter club does not move over optical sensor $S_e$. Thus, the light intensity seen by optical sensor $S_e$ (i.e., the background or ambient light striking surface 104), remains constant throughout the practice putting swing.

The output signals $V_{s1}$, $V_{s2}$ and $V_e$ are provided to a pair of comparators 160 and 162. Comparator 160 receives signals $V_{s1}$ and $V_e$ as its inputs and, in response to these inputs, comparator 160 outputs a signal representing the difference between signals $V_{s1}$ and $V_e$. Similarly, comparator 162 receives signals $V_{s2}$ and $V_e$ as its inputs and, in response to these inputs, comparator 162 outputs a signal representing the difference between signals $V_{s2}$ and $V_e$. The output of comparators 164 and 166 are respectively provided to further comparators 166 and 168. Comparators 166 and 168 each have as an input a threshold voltage set to a predetermined fixed level ($V_{thresh}$). When the signal provided from comparator 160 reaches the level of $V_{thresh}$, comparator 164 outputs a signal ($S_{timer_on}$) to a timer 168. In the preferred embodiment, the moment that the signal provided from comparator 164 reaches the level of $V_{thresh}$ corresponds to the point in time during the practice putting swing when the club head is directly over sensor $S_1$. When the timer 168 receives the signal $S_{timer_on}$ from comparator 164, the timer 168 begins counting clock cycles. Next, when the signal provided from comparator 166 reaches the level of $V_{thresh}$, comparator 166 outputs a signal ($S_{timer_off}$) to the timer 168. In the preferred embodiment, the moment that the signal provided from comparator 166 reaches the level of $V_{thresh}$ corresponds to the point in time during the practice putting swing when the club head is directly over sensor $S_2$. When the timer receives the signal $S_{timer_off}$ from comparator 166, the timer 168 stops counting clock cycles, and the outputs a value (delta T) to controller 170. This delta T value represents the number of clock cycles that were counted between the times when signals $S_{timer_on}$ and $S_{timer_off}$ were respectively received by the timer 168. Thus, the delta T value corresponds to the amount of time taken for the club head to travel from a location directly above the sensor $S_1$ to a location directly above sensor $S_2$ during the practice swing. As explained more fully below, this deltaT value is used by device 100 to determine: (i) the velocity of the club head as it travels from a position above sensor $S_1$ to a position above sensor $S_2$ during the practice swing, and (ii) a predicted distance that a golf ball would have traveled on a putting green if the golf ball had been struck by the putter club head during the practice swing.

Referring still to FIG. 3, the deltaT value output by timer 168 is provided to a controller or microprocessor 170, which is in turn coupled to a computer memory 172. The computer memory 172 preferably contains at least one lookup table which holds parameters representing a regressed equation corresponding to each combination of values that may be input by a user using buttons 140*a*, 140*b*, 140*c*. Based on the slope, moisture and green identification values input through buttons 140*a*, 140*b*, 140*c*, the controller 170 determines (or fetches) the regressed equation from the lookup table that corresponds to the slope, moisture and green identification values input by the user and, applies the deltaT value output by timer 168 to this regressed equation to determine a predicted distance value and, thereafter, the controller outputs this predicted distance value to the user via display 110. The regressed equation values in the lookup table may be determined using mathematical modeling. For example, the controller 170 preferably calculates each predicted distance value using a regressed equation of the form of equation (1) below:

$$\log y = a + b * \log x \qquad (1)$$

where, y is the predicted distance the golf ball will travel, x is the club head velocity determined by dividing deltaT by a value corresponding to "d", and a and b are constants which vary depending on the moisture level, slope of the putt, and the green on which the putting is to occur.

The regressed equation values (including the constants a and b) stored in the lookup table may be determined empirically by repeatedly placing a golf ball on the upper surface 104 of device 100 near sensors $S_1$ and $S_2$, striking the ball with a putting stroke, recording the deltaT value output by timer 168 for the swing, and measuring and then recording the distance that the golf ball actually traveled in response to the swing. By repeating this process for 100 or more practice strokes, a separate table of 100 or more predicted distance values corresponding to various club head velocities may be developed for each combination of moisture, slope and green identification values. Set forth in Table I below is an exemplary lookup table that was determined in accordance with this empirical method. The time values in the table set forth below represent clock cycles counted by timer 168.

TABLE I

| TIME IN CLOCK CYCLES | ACTUAL DISTANCE (in feet) | CLUB VELOCITY (in feet/sec) |
|---|---|---|
| 127.0000 | 33.0000 | 16.4042 |
| 154.0000 | 23.5833 | 13.5281 |
| 178.0000 | 29.5000 | 11.7041 |
| 184.0000 | 31.4167 | 11.3225 |
| 185.0000 | 29.0000 | 11.2613 |
| 186.0000 | 16.0000 | 11.2007 |
| 193.0000 | 32.0833 | 10.7945 |
| 195.0000 | 24.6670 | 10.6838 |
| 198.0000 | 25.0833 | 10.5219 |
| 200.0000 | 24.2500 | 10.4167 |
| 203.0000 | 17.5833 | 10.2627 |

TABLE I-continued

| TIME IN CLOCK CYCLES | ACTUAL DISTANCE (in feet) | CLUB VELOCITY (in feet/sec) |
|---|---|---|
| 210.0000 | 31.4167 | 9.9206 |
| 216.0000 | 42.2500 | 9.6451 |
| 219.0000 | 38.0000 | 9.5129 |
| 221.0000 | 26.7500 | 9.4268 |
| 222.0000 | 33.0167 | 9.3844 |
| 223.0000 | 24.0167 | 9.3423 |
| 235.0000 | 25.0167 | 8.8652 |
| 239.0000 | 22.5833 | 8.7169 |
| 239.0000 | 27.4167 | 8.7169 |
| 239.0000 | 29.0167 | 8.7169 |
| 240.0000 | 26.8333 | 8.6806 |
| 242.0000 | 27.2500 | 8.6088 |
| 246.0000 | 24.7500 | 8.4688 |
| 251.0000 | 22.4167 | 8.3001 |
| 252.0000 | 13.7500 | 8.2672 |
| 257.0000 | 21.0833 | 8.1064 |
| 258.0000 | 31.0000 | 8.0749 |
| 262.0000 | 30.9167 | 7.9517 |
| 263.0000 | 18.6667 | 7.9214 |
| 269.0000 | 25.8333 | 7.7447 |
| 269.0000 | 30.9167 | 7.7447 |
| 272.0000 | 19.0167 | 7.6593 |
| 274.0000 | 24.8330 | 7.6034 |
| 275.0000 | 23.4167 | 7.5758 |
| 275.0000 | 25.0000 | 7.5758 |
| 276.0000 | 22.8333 | 7.5483 |
| 277.0000 | 17.0000 | 7.5211 |
| 282.0000 | 18.3330 | 7.3877 |
| 283.0000 | 17.8333 | 7.3616 |
| 287.0000 | 26.2500 | 7.2590 |
| 292.0000 | 23.3330 | 7.1347 |
| 300.0000 | 11.3330 | 6.9444 |
| 306.0000 | 18.0000 | 6.8083 |
| 307.0000 | 24.0000 | 6.7861 |
| 308.0000 | 23.0833 | 6.7641 |
| 309.0000 | 23.5000 | 6.7422 |
| 309.0000 | 35.5000 | 6.7422 |
| 310.0000 | 23.6670 | 6.7204 |
| 310.0000 | 23.7500 | 6.7204 |
| 322.0000 | 18.3330 | 6.4700 |
| 325.0000 | 8.9167 | 6.4103 |
| 328.0000 | 18.0000 | 6.3516 |
| 328.000 | 19.0167 | 6.3516 |
| 336.0000 | 21.0000 | 6.2004 |
| 338.0000 | 13.6667 | 6.1637 |
| 339.0000 | 14.2500 | 6.1455 |
| 343.0000 | 17.9167 | 6.0739 |
| 343.0000 | 19.0000 | 6.0739 |
| 347.0000 | 16.0000 | 6.0038 |
| 356.0000 | 17.0000 | 5.8521 |
| 357.0000 | 12.0167 | 5.8357 |
| 357.0000 | 16.3330 | 5.8357 |
| 365.0000 | 15.3330 | 5.7078 |
| 369.0000 | 10.4167 | 5.6459 |
| 370.0000 | 16.9167 | 5.6306 |
| 382.0000 | 9.5833 | 5.4538 |
| 386.0000 | 13.9167 | 5.3972 |
| 388.0000 | 15.7500 | 5.3694 |
| 396.0000 | 10.5000 | 5.2609 |
| 401.0000 | 9.4167 | 5.1953 |
| 404.0000 | 7.0833 | 5.1568 |
| 413.0000 | 9.7500 | 5.0444 |
| 414.0000 | 13.9167 | 5.0322 |
| 415.0000 | 7.9167 | 5.0201 |
| 415.0000 | 13.0167 | 5.0201 |
| 446.0000 | 12.0000 | 4.6712 |
| 458.0000 | 7.6667 | 4.5488 |
| 464.0000 | 10.5000 | 4.4899 |
| 468.0000 | 8.5000 | 4.4516 |
| 475.0000 | 12.4167 | 4.3860 |
| 477.0000 | 9.4167 | 4.3676 |
| 492.0000 | 9.0167 | 4.2344 |
| 514.0000 | 8.6667 | 4.0532 |
| 527.0000 | 6.9167 | 3.9532 |
| 531.0000 | 7.0833 | 3.9234 |

TABLE I-continued

| TIME IN CLOCK CYCLES | ACTUAL DISTANCE (in feet) | CLUB VELOCITY (in feet/sec) |
|---|---|---|
| 532.0000 | 6.0833 | 3.9160 |
| 532.0000 | 10.3330 | 3.9160 |
| 550.0000 | 9.0830 | 3.7879 |
| 580.0000 | 5.0000 | 3.5920 |
| 642.0000 | 5.4167 | 3.2451 |
| 665.0000 | 4.9167 | 3.1328 |
| 728.0000 | 4.5000 | 2.8617 |

Application of a regression analysis to the above table yields an equation in the form of equation (1) above, where a=1.69 and b=1.107.

In a preferred embodiment, the controller 170 includes an interpolator for interpolating between various predicted distance values in the event that the user inputs moisture and slope values which do not correspond identically to one of the regressed equations included in the table.

In a preferred embodiment of the present invention, a plurality of regressed equations are stored in the memory 172. Each of the different regressed equations may be formulated by taking actual putting measurements (such as those shown in Table I) at each of a plurality of holes at different slopes and moisture conditions, and for each set of measurements applying a regression analysis in order to arrive at a regressed equation corresponding to a particular set of putting conditions at a particular hole. Each of the regressed equations stored in memory 172 preferably corresponds to a specific hole at certain slope and moisture conditions, the combination of which may be input to device 100 by a golfer using interface 120. Thus, there may be several regressed equations which are stored for a single given hole at a particular golf course; for the given hole, each such regressed equation preferably corresponds to the combination of a specific putting slope (e.g., uphill, downhill or level) and a particular moisture condition (e.g., wet, normal, dry).

Figure 4:
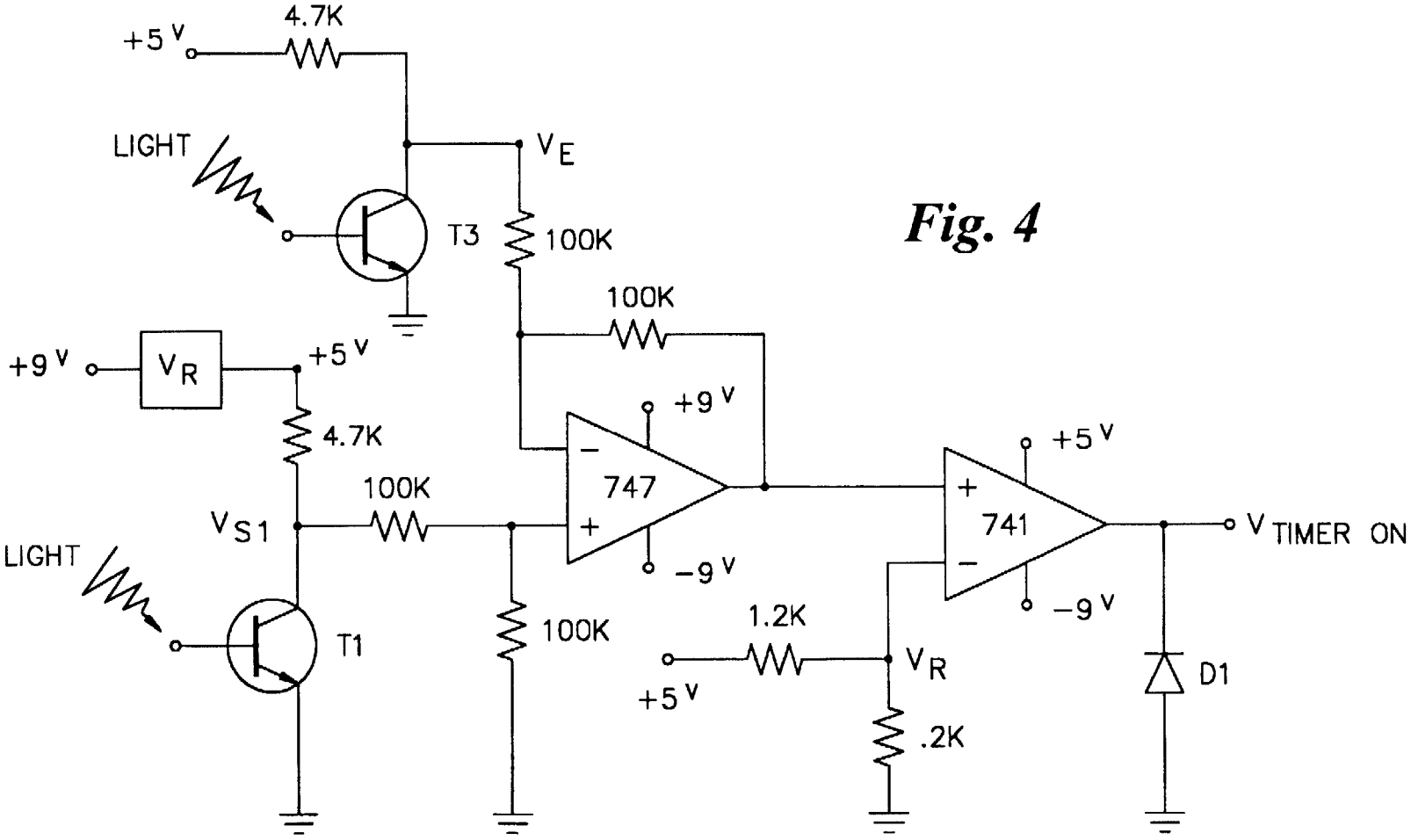
FIG. 4 is a diagram showing an exemplary circuit for detecting the movement of a putter club head over an optical sensor, in accordance with a preferred embodiment of the present invention.
Figure 5:
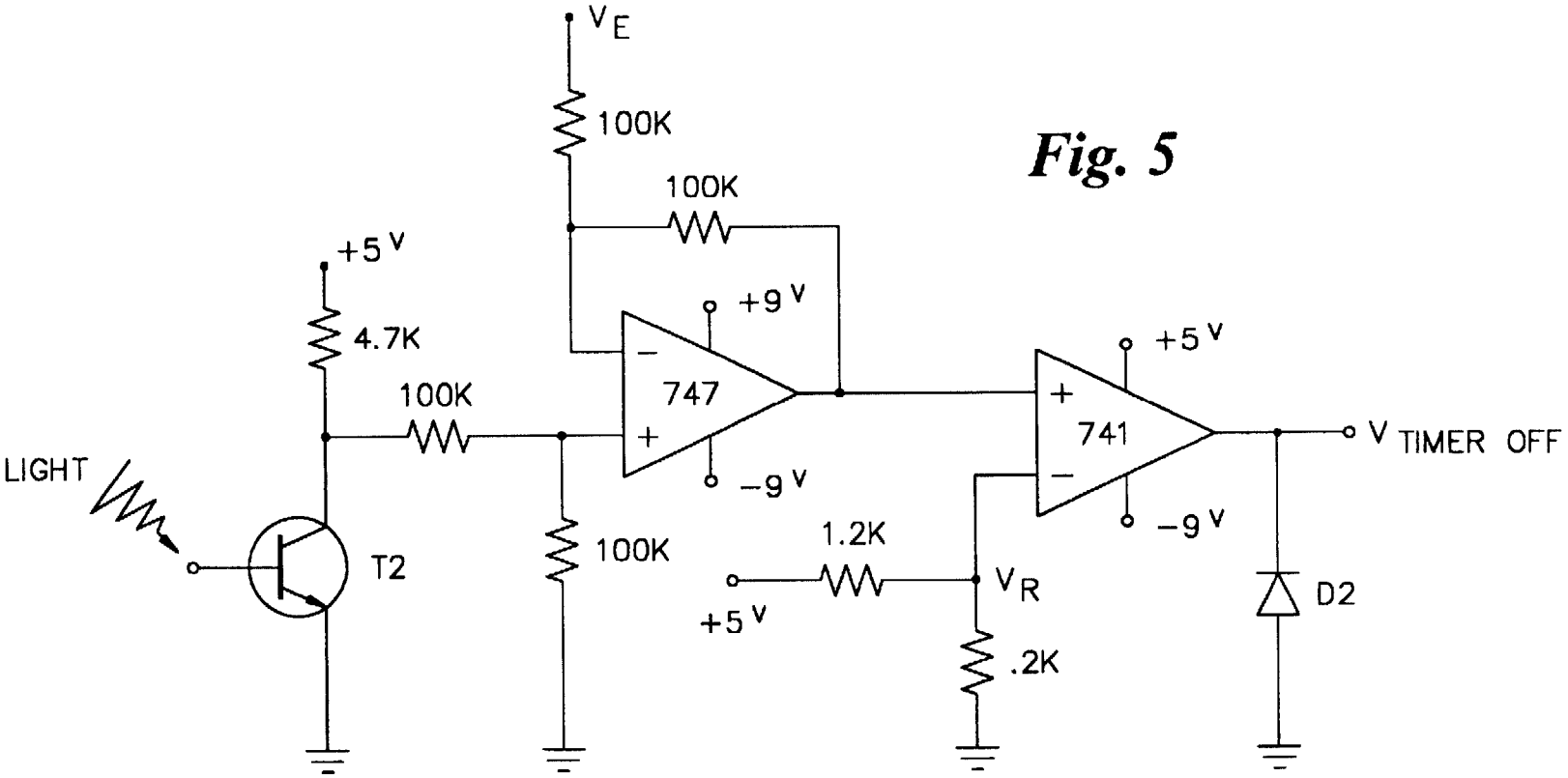
FIG. 5 is a diagram showing a further exemplary circuit for detecting the movement of a putter club head over an optical sensor, in accordance with a preferred embodiment of the present invention.

Referring now to FIGS. 4 and 5, there are shown diagrams of two exemplary circuits for detecting the movement of a putter club head over an optical sensor, in accordance with a preferred embodiment of the present invention. The exemplary circuit shown in FIG. 4 performs the same function as the comparators 160 and 164 shown in FIG. 3, while the exemplary circuit shown in FIG. 5 performs the same function as the comparators 162 and 166 shown in FIG. 3. Referring specifically to FIG. 4, two 9-volt batteries power the circuitry to obtain positive and negative 9-volt terminals. The positive terminal is connected to a 5-volt voltage regulator, VR. Two phototransistors, T1 and T3, with collector voltages denoted as $V_{s1}$ and $V_e$ are also provided. The difference between $V_{s1}$ and $V_E$ is taken by utilizing a 747 Differential Amplifier. The rails of the Differential Amplifier are set to +9 volts and −9 volts. The difference between $V_{s1}$ and $V_E$ is then transmitted to the positive input of a 741 Operational Amplifier, where this difference value is compared to a reference voltage, $V_R$, preferably set to 0.75 volts. The reference voltage is obtained from a voltage divider. The rails of the 741 Operational Amplifier are set to +5 volts and −9 volts. The output, $V_{Timer_on}$, of the 741 Operational Amplifier is grounded through a diode, D1, thus allowing for a logic output from the 741 Operational Amplifier. The difference between $V_{s2}$ and $V_E$ is similarly taken using the circuitry shown in FIG. 5, thus allowing for two high or low logic output signals, $V_{timer\text{-}on}$ and $V_{timer_off}$.

Figure 6:
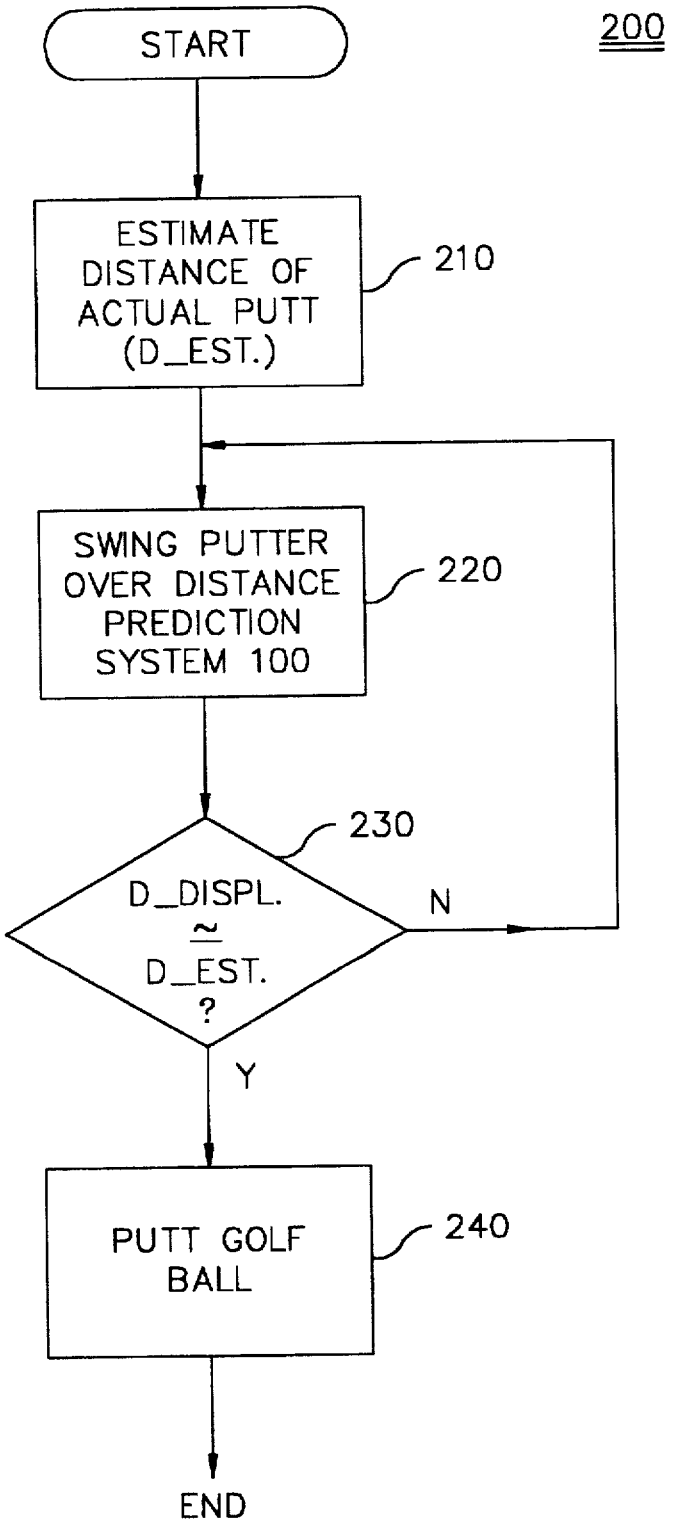
FIG. 6 is a flow diagram showing a method which uses the device illustrated in FIG. 1 in order to more accurately putt a golf ball positioned on a putting green, in accordance with a further preferred embodiment of the present invention.

Referring now to FIG. 6, there is shown a flow diagram of a method which a golfer may use in conjunction with device 100 in order to more accurately putt a golf ball positioned on a putting green, in accordance with a further aspect of the present invention. Initially, in step 210, a golfer faced with an actual putting situation during a game begins by estimating (either by sight or with a distance measuring device), the actual putting distance between the golf ball as positioned on the putting green and the hole on the putting green. Next, in step 220, while the golf ball remains on the putting green, the golfer places device 100 on or near the green. With the device 100 so positioned, the golfer then moves a putting club head over device 100 with a practice putting swing. After the practice putting swing is performed, a predicted putting distance is provided to the golfer via display 120. Next, in step 230, while the ball remains on the putting green, the golfer compares the actual putting distance (estimated in step 210) with the predicted putting distance determined using device 100. If the actual putting distance and the predicted putting distance are not within a predetermined threshold (the threshold is preferably determined by the golfer), then the golfer repeats steps 210–220 by continuing to swing the putter club head over device 100 until the actual putting distance (estimated in step 210) and the predicted putting distance output by device 100 are within the predetermined threshold. In step 240, when the actual putting distance and the predicted putting distance (as determined using device 100) are within the predetermined threshold, the golfer then putts the golf ball toward the hole. Using this method, the golfer is able to get a "feel" for the proper velocity of the putting stroke before actually putting the golf ball toward the hole.

Furthermore, it is to be understood that although the present invention has been described with reference to a preferred embodiment, various modifications, known to those skilled in the art, may be made to the structures and process steps presented herein without departing from the invention as recited in the several claims appended hereto.

What is claimed is:

1. An apparatus for determining a predicted distance that a golf ball will travel when struck by a putter club head during a putting swing comprising:

a first optical sensor located in a first position for sensing when a putter club head travels over the first position during a putting swing;

a second optical sensor located in a second position for sensing when a putter club head travels over the second position during a putting swing the second position being a predetermined distance away from the first position;

a timer coupled to said first and second optical sensors, for generating a time difference value representing a difference between a first time when a putter club head travels over the first position during a putting swing and a second time when a putter club head travels over the second position during a putting swing;

a microprocessor for determining a predicted distance in accordance with said time difference value and the predetermined distance;

a lookup table, coupled to said microprocessor for storing a plurality of regressed equation values, wherein said microprocessor determines the predicted distance by retrieving at least one of said regressed equation values from said lookup table; and means for communicating the predicted distance determined by said microprocessor to a user.

2. The apparatus of claim 1, further comprising a third optical sensor for outputting a signal representing an ambient light condition, and first means for comparing a signal output by said optical first sensor to said signal output by said third optical sensor and for determining whether said signal output by said optical first sensor and said signal output by said third optical sensor differ by more than a predetermined threshold.

3. The apparatus of claim 2, further comprising second means for comparing a signal output by said second optical sensor to said signal output by said third optical sensor and for determining whether said signal output by said second optical sensor and said signal output by said third optical sensor differ by more than said predetermined threshold.

4. The apparatus of claim 3, wherein said timer is coupled to an output of said first means for comparing and to an output of said second means for comparing, and wherein said first time corresponds to a determination by said first means for comparing that said signal output by said optical first sensor and said signal output by said third optical sensor differ by more than said predetermined threshold, and said second time corresponds to a determination by said second means for comparing that said signal output by said optical second sensor and said signal output by said third optical sensor differ by more than said predetermined threshold.

5. The apparatus of claim 1, further comprising means for said user to input a slope value.

6. The apparatus of claim 1, further comprising means for said user to input a moisture value.

7. The apparatus of claim 1, further comprising means for said user to select a putting green from a plurality of candidate putting greens, and wherein said lookup table corresponds to said selected putting green.

8. The apparatus of claim 1, wherein said first and second optical sensors are disposed in a housing, and said means for communicating comprises a visual display disposed in said housing.

9. The apparatus of claim 8, wherein said housing has a flat upper surface, and said first and second optical sensors are disposed in a recessed position below said flat upper surface.

10. The apparatus of claim 8, wherein said housing has a flat bottom surface, and a plurality of spikes are affixed to said flat bottom surface to secure said apparatus on a surface of a putting green.

11. A method for accurately putting a golf ball positioned on a putting green, comprising the steps of:

(A) providing the apparatus of claim 1;

(B) estimating an actual putting distance between said golf ball and a hole on said putting green;

(C) while said golf ball remains positioned on said putting green, moving a putting club head over said first and second optical sensors with a practice putting swing to determine a predicted putting distance;

(D) while said golf ball remains positioned on said putting green, comparing said actual putting distance with said predicted putting distance;

(E) if said actual putting distance and said predicted putting distance are not within a predetermined threshold, then repeating steps (C) and (D) until said actual putting distance and said predicted putting distance are within said predetermined threshold; and (F) if said actual putting distance and said predicted putting distance are within said predetermined threshold, then putting said golf ball toward said hole.

12. The method of claim 11, wherein said pair of sensors are located in a housing, further comprising the step of placing said housing on said putting green prior to performing step (B).

13. The method of claim 12, wherein said housing is placed at a positioned proximate said golf ball prior to step (B).

* * * * *